United States Patent [19]

Morris

[11] 3,951,059

[45] Apr. 20, 1976

[54] APPARATUS FOR CRUSHING MATERIAL

[75] Inventor: Drew W. Morris, Hampton, N.H.

[73] Assignee: Drew-It Corporation, Hampton Falls, N.H.

[22] Filed: Jan. 20, 1975

[21] Appl. No.: 542,557

Related U.S. Application Data

[63] Continuation-in-part of Ser. No. 400,179, Sept. 24, 1973, abandoned, which is a continuation-in-part of Ser. No. 230,302, Feb. 29, 1972, Pat. No. 3,776,128.

[52] U.S. Cl. ..... 100/173; 100/172; 100/176; 100/DIG. 2; 241/99

[51] Int. Cl.[2] ..... B30B 3/04

[58] Field of Search ..... 100/DIG. 2, 176, 171, 100/172, 173; 241/99, 155, 156, 232, 159

[56] References Cited

UNITED STATES PATENTS

| | | | |
|---|---|---|---|
| 382,973 | 5/1888 | Groat | 241/159 |
| 1,486,360 | 3/1924 | Brown | 100/176 X |
| 1,620,659 | 3/1927 | Hodgkinson | 100/DIG. 2 |
| 1,823,955 | 9/1931 | Sargent et al. | 100/173 X |
| 2,174,735 | 10/1939 | Clugston | 241/232 |
| 2,564,464 | 8/1951 | Christopher et al. | 241/232 |
| 3,036,517 | 5/1962 | Malarsky | 100/DIG. 2 |
| 3,066,600 | 12/1962 | Couty et al. | 100/DIG. 2 |
| 3,412,837 | 11/1968 | Myers | 100/DIG. 2 |
| 3,504,621 | 4/1970 | Qualheim | 100/176 X |
| 3,659,520 | 5/1972 | Garrett et al. | 100/DIG. 2 |
| 3,687,062 | 8/1972 | Frank | 100/176 X |
| 3,749,004 | 7/1973 | Pagdin | 100/171 X |
| 3,827,351 | 8/1974 | Rosenow | 100/DIG. 2 |

*Primary Examiner*—Billy J. Wilhite
*Attorney, Agent, or Firm*—Kenway & Jenney

[57] ABSTRACT

An apparatus for crushing materials such as cans into flat plate-like forms. The crushing apparatus comprises a hopper for receiving material-to-be-crushed, a feeder, and a symmetrical array of vertically stacked pairs of parallelly aligned, opposed counter-rotating rollers. The feeder includes a rotating element having an axis of rotation parallel to the rotational axes of the rollers, and further having two opposed elongated feed members, each being disposed with a corresponding longitudinal axis substantially parallel to and displaced a predetermined distance from the rotating element axis of rotation. The rotating element is pivotally mounted on a pair of spring loaded lever arms in a manner permitting displacement of its rotational axis between predetermined limits along a cylindrical surface of rotation having an axis of revolution parallel to the roller axes. The feeder is positioned relative to the roller array such that the feeder rotating element axis of rotation is offset from the plane of symmetry between the opposed rollers. The rollers forming one side of the array are mounted on a pair of spring loaded lever arms which force the lowermost pair of rollers into contact to form a downwardly converging array when no material-to-be-crushed is between the lowermost rollers, and which allow the array to expand otherwise. A driving means rotates the rollers and feeder rotating element so that material-to-be-crushed introduced to the feeder is passed downwardly through the array.

14 Claims, 8 Drawing Figures

APPARATUS FOR CRUSHING MATERIAL

This application is a continuation-in-part appication of application Ser. No. 400,179, filed Sept. 24, 1973, now abandoned. Application Ser. No. 400,179 was a continuation-in-part application of application Ser. No. 230,302, filed Feb. 29, 1972, now U.S. Pat. No. 3,776,128.

FIELD OF THE INVENTION

This invention relates in general to recycling and resource recovery systems and more particularly to an apparatus for crushing and compacting materials such as cans.

BACKGROUND OF THE INVENTION

In the employment of non-biodegradable packaging materials, such as aluminum, it has been recognized that a serious problem arises in disposing of the package after use. With respect to aluminum cans, for example, it is ecologically desirable that they be recycled and re-used. From a storage and transportation standpoint, it is more economical to decrease the volume of the used and empty cans, than it is to transport and store them in their original shape. A machine for rapidly, reliably and cheaply reducing these cans, or other similar materials, to a density of 9 to 10 pounds per cubic foot or more, which can be located wherever used cans are collected for transporation to recycling and recovery systems, is highly desirable.

Available hydraulic crushing mechanisms are cumbersome and expensive. Prior art rolling and pressing mechanisms normally require that an object be forced into them to crush it. Ribbed rollers of the so-called self-feeding type do not normally require that the object be forced between them, but often become blocked if the object is not properly aligned. Either system often results in a slow feed operation and substantially low system efficiency.

It is therefore highly desirable to have a machine that is relatively inexpensive, reliable, efficient and simple to operate which will rapidly collapse and compact materials such as cans to a density of between nine to ten pounds per cubic foot.

SUMMARY OF THE INVENTION

Broadly speaking, this invention provides a material crushing apparatus which operates in the following manner. Materials such as cans are dumped randomly into a hopper or bin, which can be located directly over a roller feed chute, or over a feed conveyor which picks up cans at the bottom of the bin and drops them into the roller feed chute. As the cans fall into the chute, they pass to a feeder and then to a symmetrical array of vertically stacked pairs of parallelly aligned, opposed counter-rotating rollers disposed below the feeder. The feeder agitates and orients the cans and prevents a can from blocking the rollers below.

The feeder includes a rotating element having an axis of rotation parallel to the rotational axes of the rollers. The rotating element is formed with two opposed elongated feed members extended parallel to the axis of rotation, with each feed member being disposed with a corresponding longitudinal axis substantially parallel to and an equal predetermined distance from the rotating element axis of rotation. This rotating element is pivotally mounted on a pair of spring loaded lever arms in a manner permitting displacement of its rotational axis between predetermined limits along a cylindrical surface of rotation. The feeder is positioned relative to the roller array such that the feeder rotating element axis of rotation is offset from the plane of symmetry between the opposed rollers.

The rollers forming one side of the array are mounted on a pair of spring loaded lever arms which force the lowermost pair of rollers into contact to form a downwardly converging symmetrical array when no material-to-be-crushed is between the lowermost rollers, and which otherwise permit displacement of the rollers on that side away from the plane of symmetry in a pivotal motion about a lever arm axis located above said array.

DESCRIPTION OF THE DRAWINGS

For a fuller understanding of the nature and objects of the invention, reference should be had to the following detailed description, taken in connection with the accompanying drawings, in which.

DETAILED DESCRIPTION OF THE INVENTION

Figure 1:
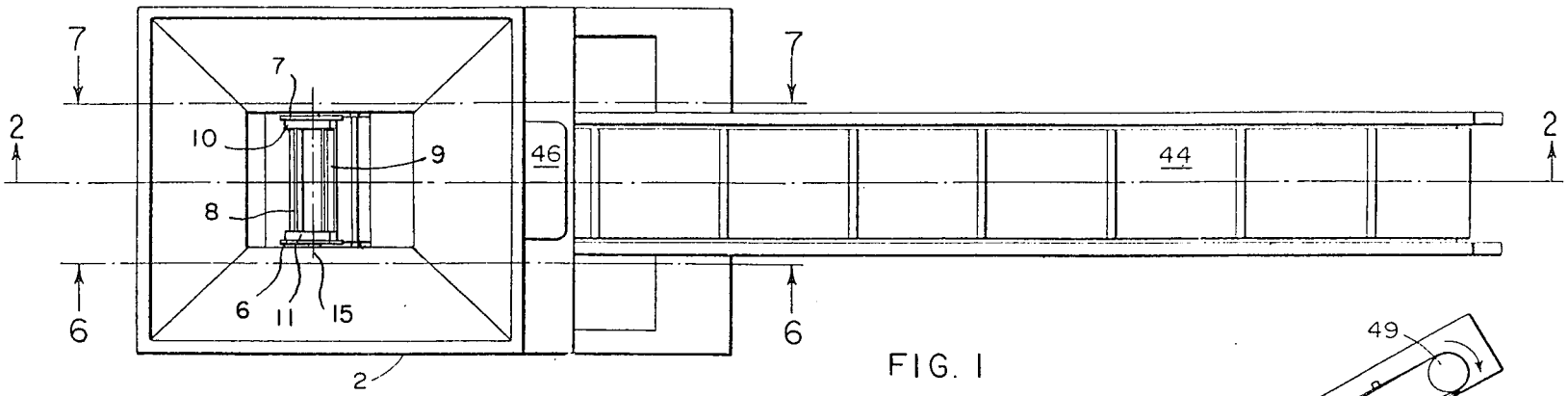
FIG. 1 is a plan top view of an overall design in accordance with this invention.
Figure 2:
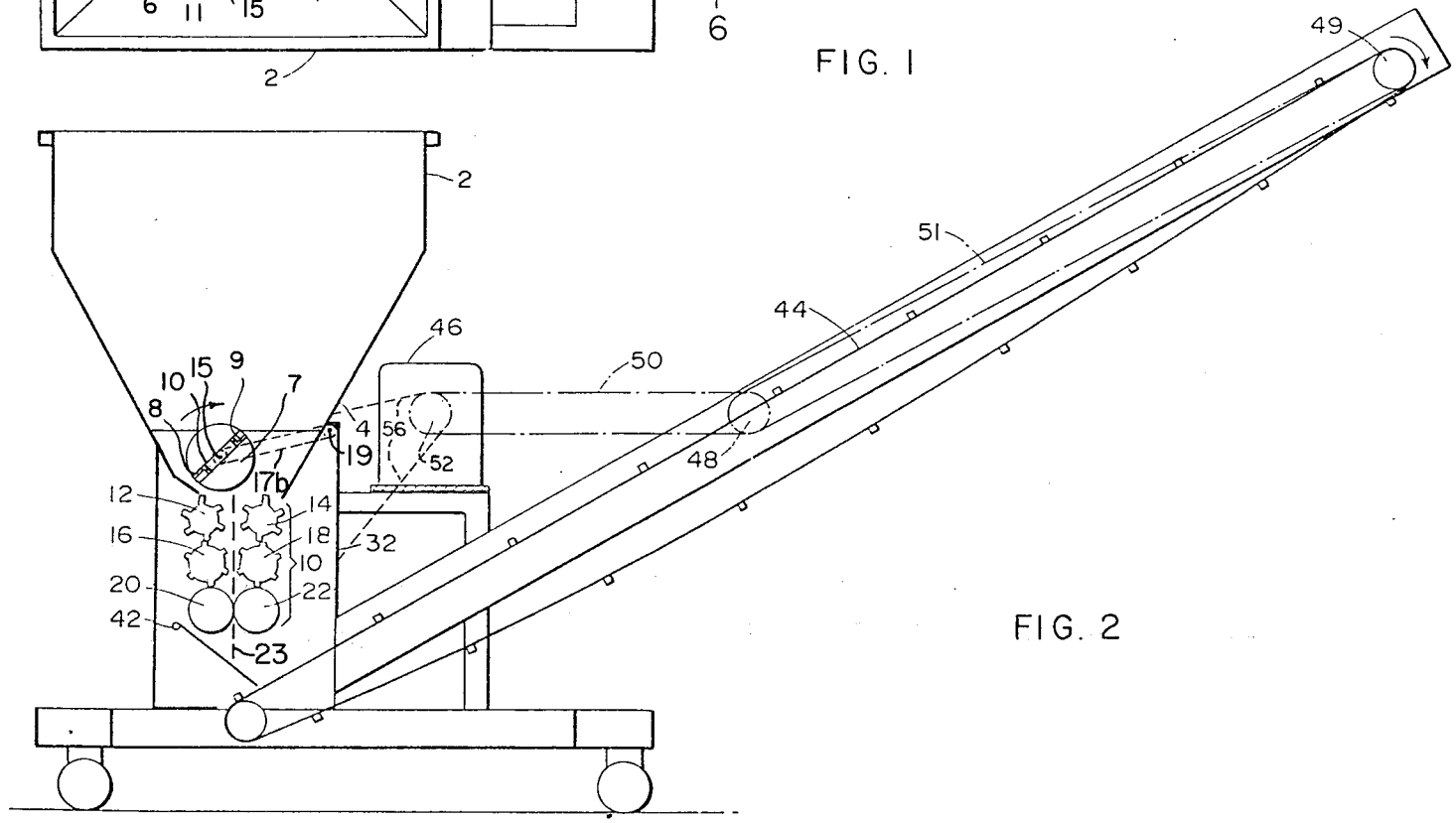
FIG. 2 is a front sectional view, taken along section 2, of this invention.

Referring to FIGS. 1 and 2, a material crushing apparatus is shown with a bin 2, in which empty cans are deposited. The cans deposited in bin 2 collect in feed chute 4 below. At the bottom of feed chute 4 is a feeder 5, located directly above a downwardly converging array 10 of pairs of opposed parallelly aligned rollers 12 and 14, 16 and 18, 20 and 22. The array 10 is symmetrical with rollers 12, 16 and 20, forming one column, and rollers 14, 18 and 22, forming a second column, where the columns are disposed on opposite sides of a plane of symmetry 23 (indicated by the dotted line 23 in FIG. 2) passing between the columns.

Figure 3:
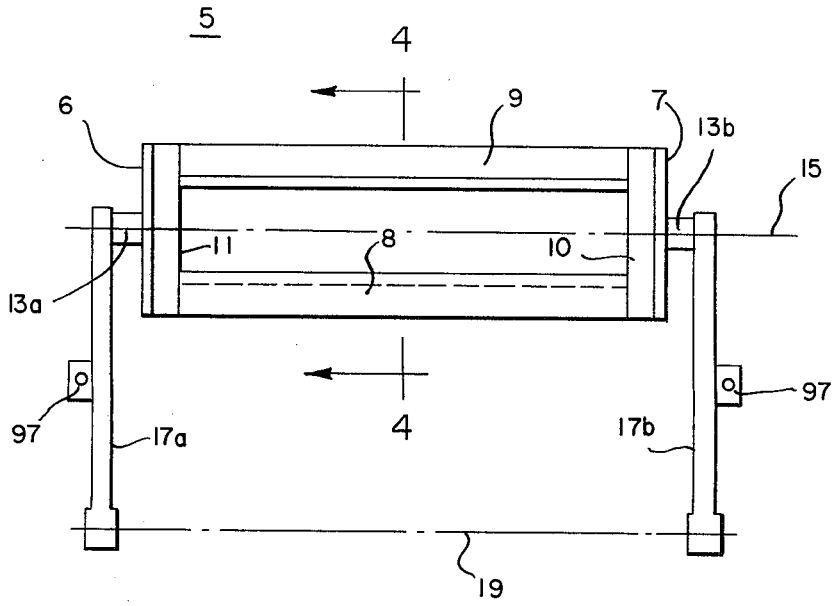
FIG. 3 is a plan view of the rotating element of the feeder in the embodiment of FIG. 1.
Figure 4:
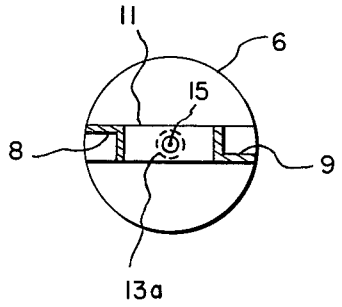
FIG. 4 is a sectional view taken along section 4 of the element of FIG. 3.

Feeder 5 (shown in detailed form in FIGS. 3 and 4) comprises a rotating element including circular disc end members 6 and 7, elongated right angle feed members 8 and 9, their support bars 10 and 11, and shaft members 13*a* and 13*b*, which extend about the feeder rotational axis 15. The feeder 5 further comprises lever arms 17*a* and 17*b* which constrain motion of the rotating element axis 15 along a segment of a cylindrical surface of revolution about axis 19. The shaft members 13*a* and 13*b* pass through slots 25*a* and 25*b*, respectively (shown in FIGS. 6 and 7), in chute 4 and its outer casing so that the rotating element lies within chute 4 and arms 17*a* and 17*b* are outside chute 4.

The lever arms 17*a* and 17*b* include a spring loaded feeder return means (described more fully below in conjunction with FIGS. 6 and 7) to allow angular movements of those arms so that the rotating element rotational axis always lies between predetermined upper and lower limits on the surface of revolution. The feeder return means urges the rotating element to a position where its rotational axis approaches the lower predetermined limit and allows the rotating element to be displaced to a position where its rotational axis lies above the lower limit when the force tending to displace the rotating element exceeds the force applied by the feeder return means to the rotating element.

Figure 5:
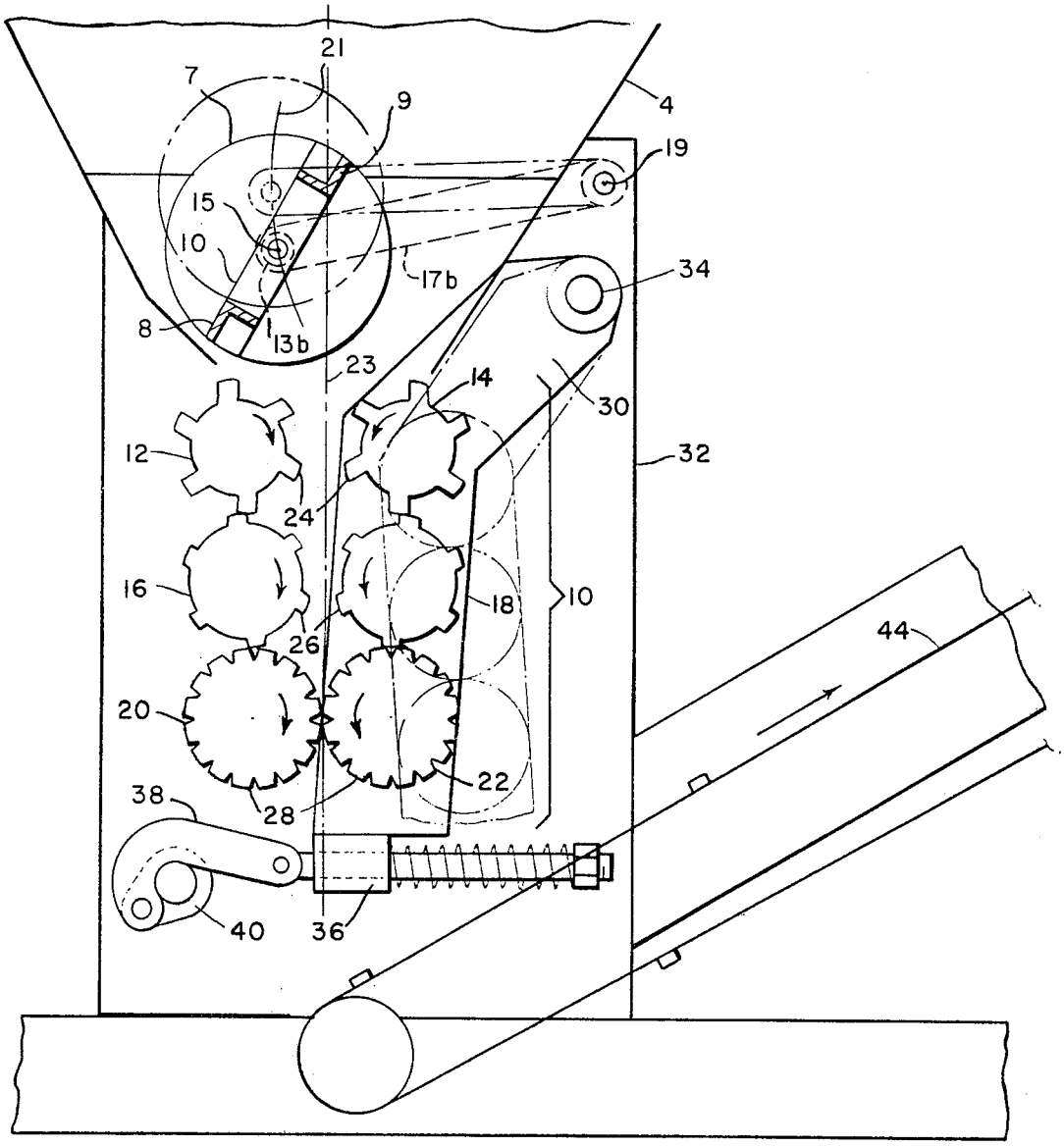
FIG. 5 is an enlarged front sectional view of the crushing mechanism shown in FIG. 2.

Referring to FIG. 5, the upper pair of opposed counter-rotating rollers 12 and 14 each have six ribs 24 extending their length. A similar, but slightly less deep, set of longitudinal ribs 24 extend the length of the middle rollers 16 and 18. The outer surfaces 28 of the lowermost set of rollers are longitudinally grooved and make contact along the apex of the array 10.

At their first and rear ends, rollers 14, 18 and 22 are rotatably mounted on a compression means comprising a spring loaded pair of support arms 30. As shown, the rear arm 30 is pivotally mounted to frame 32 by pin 34, about an axis above and to the right of array 10. Below and to the right of array 10, a compression member 36 imposes a substantial inwardly directed force on arm 30 which holds rollers 20 and 22 in compressive contact when no material-to-be-crushed lies between the rollers. Compression member 36 is held in position by a latch 38 which is hooked over a pin 40 attached to the frame 32 to the left and slightly below array 10. When material-to-be-crushed lies between the rollers, the spring loaded lever arms 30 may displace the rollers 14, 18 and 22 away from the plant of symmetry 23 in a pivotal motion about the rotational axis of lever arms 30. In the embodiments shown in FIGS. 1–8, the pivoting axis of lever arms 30 is disposed on the same side of the plane of symmetry 23 as the pivot axis 19 of the feeder 5. In other embodiments, this relationship may be reversed, for example, by locating axes 15 and 19 on opposite sides of plane 23.

Should an incompressible object fall into roller array 10, and be large enough to apply a moment to arms 30 that exceeds that exerted by adjustable compression member 36, arms 30 will allow array 10 to expand and discharge the object without blockage. When arms 30 reach their maximum degree of rotation, further force applied by the incompressible object causes a clutch to automatically disengage the drive means for motor drive sprocket 52 and damage to the apparatus is avoided. In addition, the motion of the clutch assembly caused by disengagement causes a change in state of an associated switch, which in turn disables the motor. The jam can then be cleared by removing the object from between the rollers and then releasing latch 38. Once latch 38 is again closed, the clutch is re-engaged, and the associated switch is returned to its original state, and operation resumed. The clutch in the present embodiment is a ratchet slip clutch, model no. SC-X4, manufactured by G & G Manufacturing Company, Omaha, Nebraska.

The feeder 5 is also shown in FIG. 5 in its extremal positions of rotation about axis 19. As shown, the rotating element axis 15 follows the arc 21 on a cylindrical surface of rotation about axis 19. The length of lever arms 17a and 17b are selected with respect to the position of their pivoting mounting means (at axis 19) so that the arc 21 is offset from the plane of symmetry 23. In the embodiments shown in FIGS. 1–8, the axes 15 and 19 are always on opposite sides of the plane of symmetry 23. In other embodiments, the length of arms **17*a* and 17*b* may be selected relative to the position of their pivoting mounting means (at axis 19) so that arc 21 is on the same side of the plane of symmetry 23 as axis 19**.

Referring again to FIG. 2, a baffle plate 42 is located below roller array 10 to direct the collapsed cans onto an upwardly slanted conveyor 44 which passes beneath roller array 10 and from there extends upwardly to the right of array 10.

Motor 46, located outside and to the right of chute 4, provides the power for this apparatus. Motor 46 is linked to sprocket 48, located midway on conveyor 44, by roller chain 50 and the main drive sprocket 52. The main drive sprocket 52 is connected through the clutch to motor 46. The conveyor drive sprocket 49, at the top of conveyor 44, is connected to sprocket 48 by roller chain 51. In other embodiments, the motor may be coupled to sprocket 52 by way of a speed reducer and the clutch.

Figure 6:
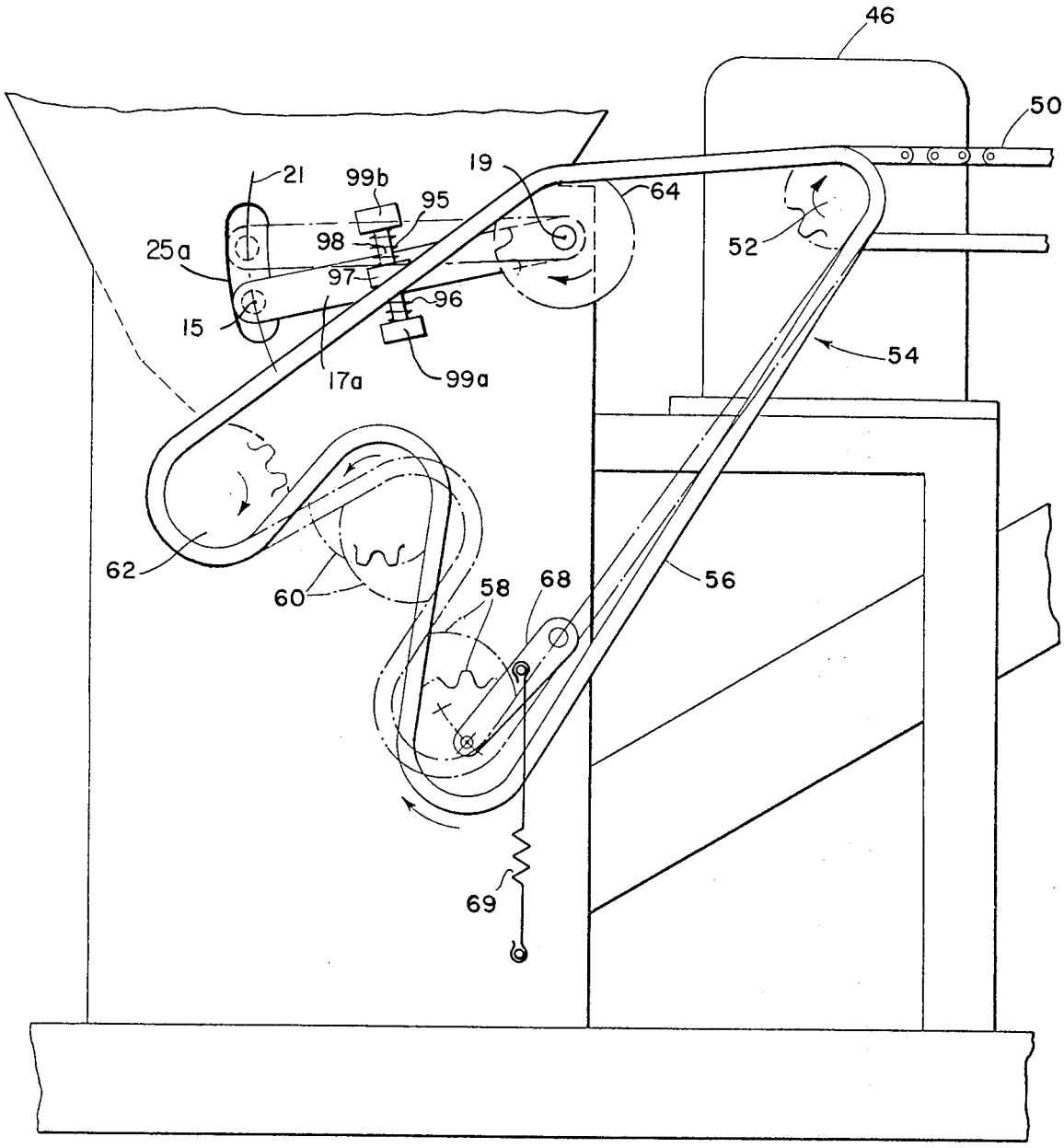
FIG. 6 is an enlarged front sectional view, taken along section 6, of the front drive system of this invention.

Referring to FIG. 6, the front drive system 54 is shown. A roller chain 56 passes around drive sprocket 52, adjustable idler sprocket 58 and sprockets 60, 62 and 64 in that order. Sprockets 60 and 62 are connected directly to the shafts of rollers 14 and 12. Sprocket 64 is mounted to rotate about axis 19, independent of the motions of lever arms **17*a* and 17*b*. Idler sprocket 58 is mounted on a spring loaded adjustable lever arm 68 biased downward by spring 69**.

Also shown in FIG. 6 is a portion of the feeder return means which couples lever arm **17*a* to the outer casing of the crusher in a manner biasing the rotating element downward while at the same time permitting upward movement when the force exerted on the rotating element by material-to-be-crushed exceeds the biasing force. This portion of the feeder return means comprises a spring loaded assembly with springs 95 and 96 mounted on a shaft 98 on either side of a lever arm stop member 97. Shaft 98 is pivotally fixed to the outer casing by member 99*a*. Member 99*b* is a stop member affixed to shaft 98. A similar assembly is mounted on arm 17*b* (shown in FIG. 7 with identical reference numerals). As a result, the spring loaded assembly limits the travel of the lever arms 17*a* and 17*b* so that the rotational axis of the rotating element lies on the above-noted cylindrical surface of revolution (indicated by arc 21) between the predetermined upper and lower limits. FIG. 6 also shows a slot 25*a* in the outer casing which permits travel of shaft 13*a* of the feeder rotating element so that the arm 17*a* may be disposed outside the chute 4**.

Figure 7:
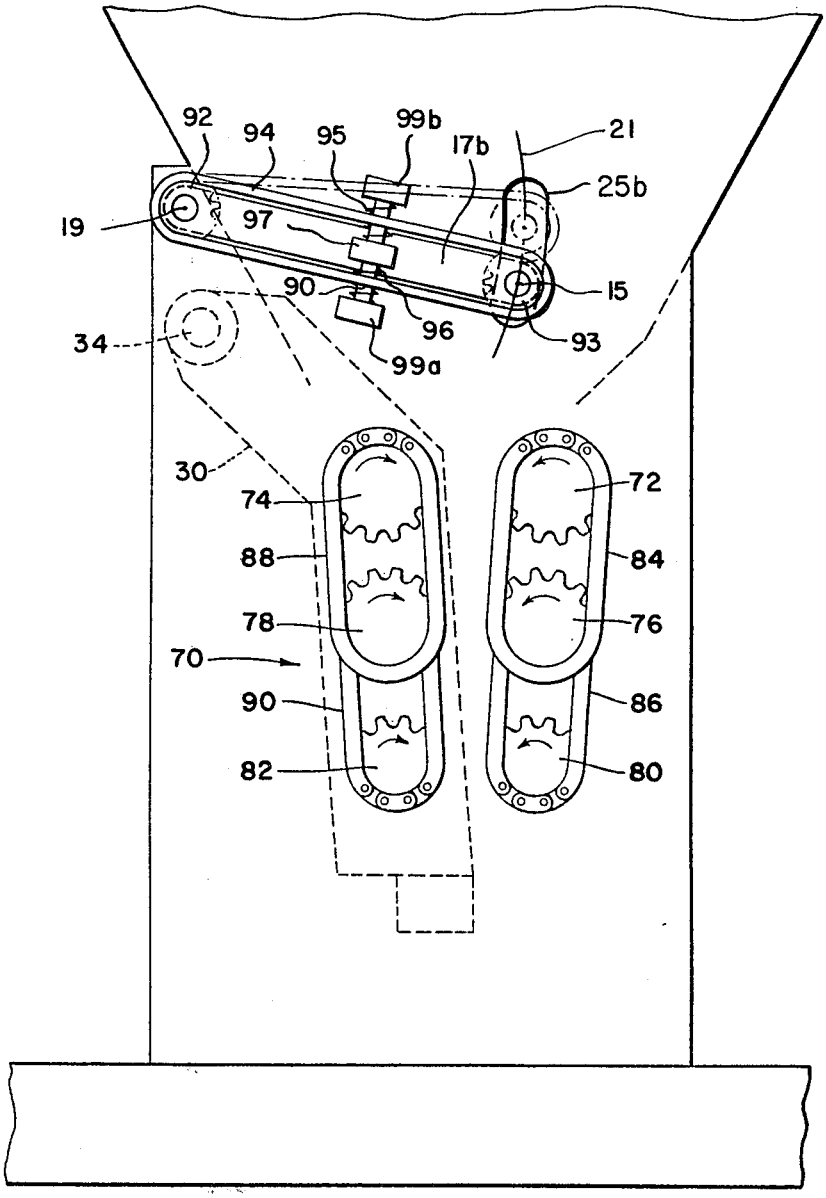
FIG. 7 is an enlarged rear sectional view, taken along section 7, of the rear drive system of this invention.

Referring to FIG. 7, the rear drive system 70 is shown. Sprockets 72 and 74 are directly connected to the drive shafts of rollers 12 and 14, respectively. Sprockets 76, 78 82 and 80 are connected to the drive shafts for rollers 16, 18, 20 and 22, respectively. Sprocket 76 is linked to sprocket 72 by roller chain 84 and sprocket 76 is in turn connected to sprocket 80 by roller chain 86. Similarly, sprocket 74 is connected by roller chain 88 to sprocket 78 and sprocket 78 is in turn linked to sprocket 82 by roller chain 90.

Sprocket 92 is mounted in a manner permitting rotation about axis 19 irrespective of the motion of the coupled lever arms **17*a* and 17*b*, and further is coupled to the sprocket 64 described above in conjunction with FIG. 6. Sprocket 93 is coupled to the feeder rotating element such that the rotating element rotates about axis 15 at the same rate as sprocket 93. Roller chain 94 couples the rotating motion of sprocket 92 to that of sprocket 93**. As noted above in conjunction with FIG.

6, arm 17*b* is also coupled to the outer casing of the crusher by the feeder return means in a manner similar to that described for arm 17*a*. The elements of the portion of the feeder return means connected to arm 17*b* and shown in FIG. 7 are denoted with identical reference numerals as the corresponding elements connected to arm 17*a* in FIG. 6. FIG. 7 also shows a slot 25*b* in the outer casing which permits travel of shaft 13*b* of the feeder rotating element so that the arm 17*b* may be disposed outside the bin 4.

Referring to FIGS. 6 and 7, in operation motor 46 drives the roller and feeder sprockets in the direction shown. Within array 10, the direction of rotation for the rollers is such that a material-to-be-crushed introduced at the top of the array is passed downwardly through the array.

Feeder 5 performs two important functions. One, it agitates the cans in chute 4 to feed a steady stream of cans into array 10 and, two, it, in combination with ribs 24, prevents any can from laying across rollers 12 and 14 without falling there between, thus preventing any blockages from arising in chute 4. In the event an object becomes wedged between feeder 5 and rollers 12 and 14, the spring loaded lever arms 17*a* and 17*b* permit the rotating element to move along arc 21, thereby preventing stall or related damage to the system.

Referring to FIG. 6, since sprocket 60 is directly connected to roller 14, it must be free to move when lever arm 30 opens to permit an incompressible object to pass through. This movement is permitted by idler sprocket 58 which adjusts its position in response to the force applied to chain 56 as sprocket 60 moves. A restoring moment is applied to idler sprocket 58 by the spring loaded pivotal support arm 68, on which it is mounted acting in concert with spring 69.

Referring to FIG. 7, the corresponding motion of sprockets 74, 78 and 82 does not require any adjustment in the paths followed by chains 88 and 90, since there is no relative change in position between these three sprockets as lever arm 30 changes position.

Figure 8:
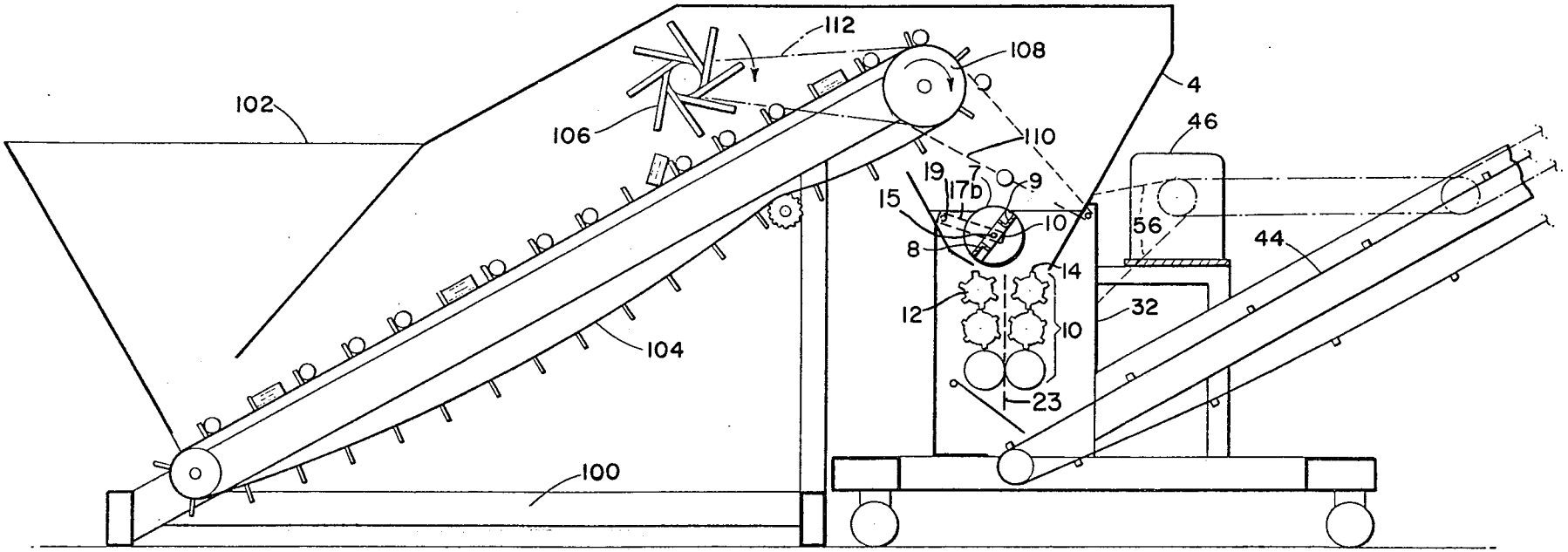
FIG. 8 is a front sectional view of another overall design in accordance with this invention.

Another embodiment of the invention is illustrated in FIG. 8. A conveyor assembly 100, located to the left of array 10, supplies cans or other crushable material to chute 4. Cans deposited in bin 102 are carried upwardly by conveyor 104 where they pass under paddle wheel 106, around sprocket 108 and are discharged into chute 4. Conveyor 104 may be linked to sprocket 64, which in this case is a double row sprocket, by roller chain 110 and conveyor drive sprocket 108. Paddle wheel 106, in turn, may be connected by roller chain 112 to conveyor drive sprocket 108, which again is a double row sprocket.

The alternative embodiment illustrated in FIG. 8 operates in the same manner as the previously described embodiment, with the added feature that cans are deposited in chute 4 by a feed conveyor 104. In this arrangement, conveyor drive sprocket 108 and paddle wheel 106 rotate in the directions shown as sprocket 64 turns. Cans, deposited in bin 102, are picked up by conveyor 104 and any cans which are improperly oriented on conveyor 102 are removed from the conveyor as they pass beneath paddle wheel 106. Since the cans released into chute 4 by conveyor 102, are generally in the proper position, the rate at which cans can be compacted by roller array 10 is further increased.

While the embodiment presently described is primarily intended for use in compacting aluminum or steel cans, it can also be employed to reduce compact glass bottles and various forms of malleable shell-like materials.

A can coming into contact with rollers 12 and 14 is grasped by ribs 24 as they rotate inwardly in the direction shown. Similarly, cans leaving rollers 12 and 14 are grasped by ribs 24 and, as they leave rollers 16 and 18, they are again gripped by the grooved surfaces of rollers 20 and 22. Thus, the cans are pulled constantly downwardly once they enter roller array 10.

The cans are successively compressed as they pass downwardly through the array and are compacted sufficiently to be pulled between rollers 20 and 22 after they leave rollers 16 and 18. Since rollers 20 and 22 are biased toward each other under the load imposed by tension member 36, the cans are completely flattened by this pair of rollers. Thus compressed, the cans fall onto conveyor 44, which carries them away from beneath roller array 10.

I have found that my invention can compress aluminum cans to a density of 9.3 pounds per cubic foot at a rate of approximately 24,000 cans per hour.

It will thus be seen that the objectives of this invention among those made apparent from the preceding description are reliably and efficiently attained and, since certain changes may be made in the above construction without departing from the scope of the invention, it is intended that all matter contained in the above description or shown in the accompanying drawings shall be interpreted as illustrative and not interpreted in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desired secured by letters Patent is:

1. An apparatus for crushing material comprising, in combination:

A. a plurality of pairs of opposed counter-rotating rollers having parallel axes of rotation, said plurality forming a two column downwardly converging array, said array being symmetrical about a plane passing between said two columns, and wherein each roller rotates in a direction so that points on that roller surface closest to said plane move in a downward direction, B. a downwardly converging feed chute disposed above said array for receiving material-to-be-crushed, and C. a feeder disposed within said feed chute for orienting and feeding said material-to-be-crushed into said array, said feeder including:

i. a rotating element having an axis of rotation parallel to the rotational axes of said rollers, said rotating element including two opposed elongated feed members, said feed members having corresponding longitudinal axes parallel to and equidistant from said rotating element axis of rotation, ii. means for pivotally mounting said rotating element in a manner permitting displacement of said rotating element rotational axis between upper and lower predetermined limits along a segment of a cylindrical surface of revolution, said surface having an axis of revolution parallel to and above said roller axes, and wherein said segment lies on one side of said array plane of symmetry, and wherein further the direction of rotation of said rotating element is the same as that for the rollers on the same side of said plane as said segment.

2. The apparatus according to claim 1 wherein said rotating element further has a circular disc end member at each end thereof, said circular disc end members being connected to the ends of said feed members, and lying in a plane perpendicular to said rotating element axis or rotation.

3. The apparatus according to claim 1 wherein said axis of revolution is on the opposite side of said plane of symmetry from said segment.

4. The apparatus according to claim 1 wherein said axis of revolution is on the same side of said plane of symmetry as said segment.

5. The apparatus according to claim 1 wherein each of the lowermost rollers is longitudinally grooved and all other rollers are longitudinally ribbed.

6. The apparatus according to claim 1 further comprising a feeder return means connected to said pivotal mounting means for urging said rotating element to a position where its rotational axis approached said lower predetermined limit, and for allowing said rotating element to be displaced to a position where its rotational axis lies above said lower predetermined limit when the force tending to displace said rotating element exceeds the force applied by said feeder return means to said rotating element.

7. The apparatus according to claim 1 further comprising a compression means connected to all of the rollers forming a first column of said array, wherein said compression means urges said first column toward the opposite column of said array and allows the rollers of said first column to be pivotally displaced about an axis located above said array and on the same side of said plane of symmetry as said axis of revolution when the force tending to displace the rollers of said first column exceeds the force applied by said compression means to these rollers.

8. The apparatus according to claim 7 wherein said first column lies on the same side of said plane of symmetry as said axis of revolution.

9. The apparatus according to claim 7 wherein said first column lies on the opposite side of said plane of symmetry from said axis of revolution.

10. The apparatus according to claim 7 further comprising a feeder return means connected to said pivotal mounting means for urging said rotating element to a position where its rotational axis approaches said lower predetermined limit, and for allowing said rotating element to be displaced to a position where its rotational axis lies above said lower predetermined limit when the force tending to displace said rotating element exceeds the force applied by said feeder return means to said rotating element.

11. The apparatus according to claim 7 wherein each of the lowermost rollers is longitudinally grooved and all other rollers are longitudinally ribbed.

12. The apparatus according to claim 7 wherein said compression means comprises a pair of spring loaded lever arms supporting said first column of said array.

13. The apparatus according to claim 1 further comprising a feed conveyor for supplying material-to-be-crushed to said array.

14. The apparatus according to claim 13 further comprising a conveyor located below said array for transporting crushed material away from said rollers as it exits from said array.

* * * * *